United States Patent [19]

Jackson et al.

[11] 4,085,633

[45] Apr. 25, 1978

[54] SPRINKLER ADJUSTOR AND ESCUTCHEON APPLICATOR TOOL

[76] Inventors: Jimmy Jackson, 4360 Vinson Ave., Macon, Ga. 31206; William D. Roquemore, Rte. 1, Box 171B, Musella, Ga. 31066

[21] Appl. No.: 758,748

[22] Filed: Jan. 12, 1977

[51] Int. Cl.[2] ..... B25B 13/28

[52] U.S. Cl. ..... 81/111; 81/53.1

[58] Field of Search ..... 81/53.1, 111

[56] References Cited

U.S. PATENT DOCUMENTS

| | | | |
|---|---|---|---|
| 1,638,703 | 8/1927 | Pendelton | 81/111 X |
| 1,897,464 | 2/1933 | Coon | 81/53.1 |
| 3,057,233 | 10/1962 | Turner | 81/53.1 X |

*Primary Examiner*—James L. Jones, Jr.
*Assistant Examiner*—James G. Smith
*Attorney, Agent, or Firm*—Dowell & Dowell

[57] ABSTRACT

A combination tool for completing sprinkler installations having pivoted clamping jaws and a wrenching tool one end of which is disposed on an elongated handle. The clamping jaws are especially adapted to engage a pivoted escutcheon plate and are operable to close the escutcheon plate in a position about a conduit or pipe while the wrench is used to engage and rotate a sprinkler drop head or similar structure and move such structure to an adjusted position.

13 Claims, 8 Drawing Figures

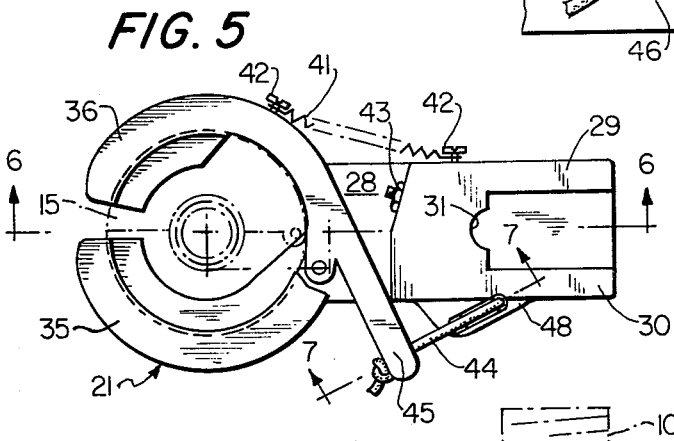
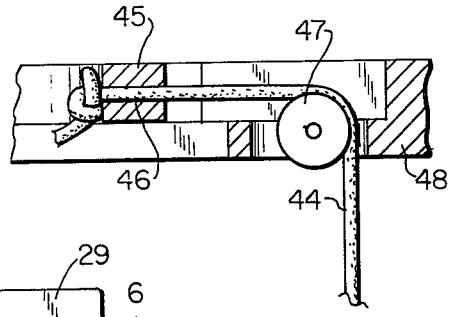
FIG. 7
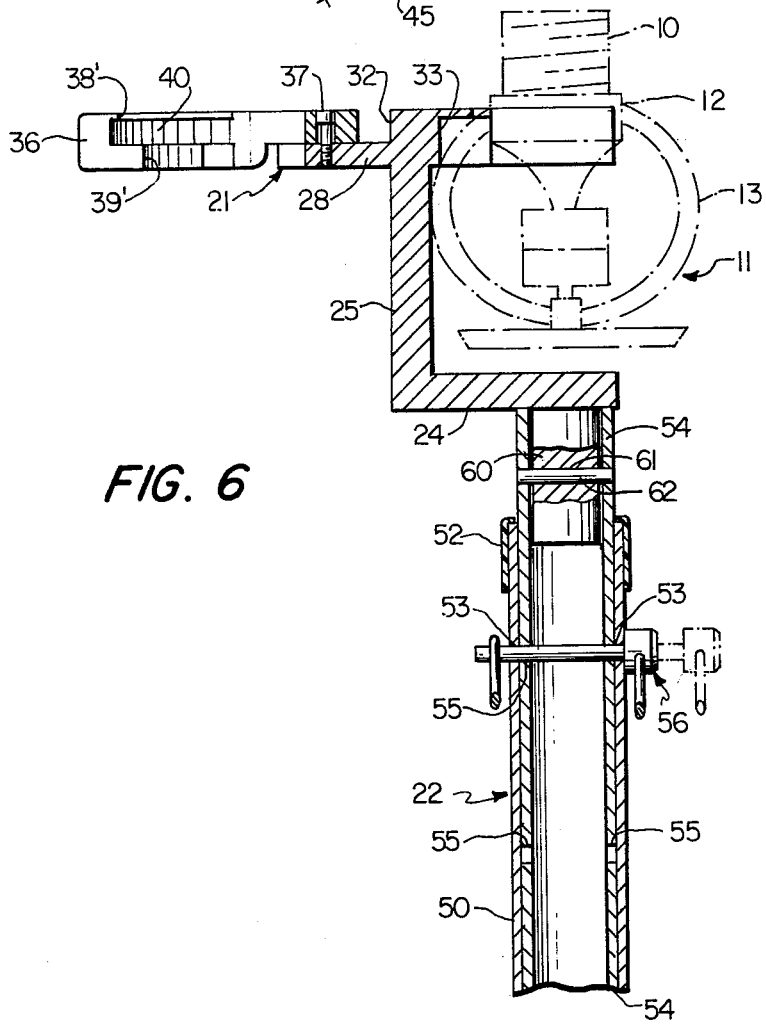
FIG. 6
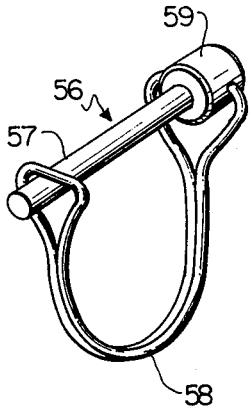
FIG. 8

SPRINKLER ADJUSTOR AND ESCUTCHEON APPLICATOR TOOL

BACKGROUND OF THE INVENTION

1. Field of the Invention

This invention relates generally to tools of various kinds and is particularly related to a combination tool having both a wrench and a pivoted jaw clamping member with both the wrench and the clamping member being operable from a remote position.

2. Description of the Prior Art

The use of escutcheon plates to form a finished look to the opened area in a wall, floor or ceiling through which pipes, tubes, conduits or other such structures are disposed has long been known. Most conventional escutcheon plates are generally ring-like in configuration and are adapted to surround a tubular protrusion while being secured by a lock, abutment, or threaded engagement so as to bear against the planar surface through which the tubular member has been extended.

As many conventional escutcheon plates are integrally formed in a continuous ring having a specific interior opening, they must be inserted in surrounding engagement over a tubular section before any valve, faucet, sprinkler or other enlarged portion is fitted to the end of such section. However, as it is often desirable to remove or place the escutcheon plate without having to disturb a fitting around which the plate would not pass, some escutcheon plates have been designed to be hindedly closeable about a conduit and locked or snapped into place thereabout.

Normally when working in areas that are readily accessible, such as in placing escutcheon plates on bathroom or kitchen plumbing fixtures, the hinged escutcheon plates may be manually clamped about the pipes with a minimum of effort. However, when working on ceiling fixtures, particularly those such as overhead fire extinguishing sprinkler systems which may be installed at considerable height above a floor, placement of the plates becomes much more of an effort.

That is, when applying escutcheon plates to pipes or other conduits which pass through ceilings, the workman must ascend a ladder or similar structure for each pipe and then awkwardly and precariously extend himself to a position in which the closure of the plate about a conduit or pipe may be accomplished. Not only is such application somewhat hazardous, but the effort and time factors make such method somewhat undesirable, particularly when applying escutcheon plates to sprinkler systems since sprinklers may be positioned in spaced locations throughout the ceiling area. Therefore, if such plates could be installed by a workman from a point well below the ceiling, such as by extending a tool while standing on the floor, a substantial saving in labor and time would be effectively accomplished.

In this regard, it is noted that there have been numerous structures and inventions designed and adapted to permit the fastening, gripping or handling of many objects which are remotely placed relative to a worker. Patents such as those to Baumgartner U.S. Pat. No. 1,544,124 and Turner U.S. Pat. No. 3,057,233 are but two examples of many of such structures. Although such devices have pivoted clamps or jaws which are disposed on long handles so that they can be used to grip articles remote from the operator's grasp, they are not of sufficient size or configuration to permit them to be used as a work holder or tool for the placement of escutcheon plates.

In addition to the placement of escutcheon plates to remote or hard to reach areas, the present invention is particularly suitable for use in completing the final adjustment of a pipe or conduit fixture relative to the surface through which such pipe extends and about which opening the aforementioned escutcheon plate is placed. In the installation of fire extinguishing systems in commercial or other buildings, recent use has been made of adjustable nipple drops which permit the extinguisher heads to be installed prior to the final placement of a ceiling, particularly with ceilings of the drop type.

When working with adjustable sprinkler drops, it is customary to extend the drops to a maximum length until the ceiling is finished. Thereafter the escutcheon plate may be clamped about the pipe and the drop tightened so that the sprinkler head is in engagement against the escutcheon plate.

In this regard, it would be extremely desirable to have a tool which could be utilized from a remote location to place the escutcheon plate in position as well as to adjust the drop so that the sprinkler head is abutted against the plate. Although many wrenches have been designed which can be used for the remote adjustment of a threaded member, such as that of the patent to Collins No. 1,408,444, such devices have not been provided in combination with a pivoted clamping member so that an overhead placement of an escutcheon plate and the subsequent adjustment of a pipe fixture can be made with a single tool.

Further, when working with a sprinkler drop or similar fixture, in order to maintain the tool handle in a generally axial relationship to the member being rotated, the opening of the wrenching tool should be aligned therewith. By providing for a tool which will circumvent the sprinkler head and thereby permit the wrench to engage the nut portion of such sprinkler while maintaining the handle in axial alignment with the sprinkler drop, a simple rotational movement of the handle about its axis is all that is required to effect adjustment of the drop.

SUMMARY OF THE INVENTION

The present invention is embodied in a tool for handling and applying escutcheon plates and adjusting fixtures relative thereto in which the tool has a tool head disposed at one end of an elongated handle. The tool head has both a normally open pivoted escutcheon plate clamping member operable from a point remote from the tool head and a wrench member disposed on the opposite side thereof. The tool head is disposed in an offset relation to the axis of the tool handle so that the opening formed by the jaws of the wrench is generally in alignment with the axis of the tool handle.

It is the primary object of this invention to provide a tool for manipulating and placing hinged type escutcheon plates about various conduits or pipes at locations remote from a worker's normal physical grasp such as in overhead or ceiling applications.

It is another object of this invention to provide a wrench which is mounted on an elongated handle with the wrench opening being disposed generally perpendicular to and in alignment with the axis of the tool handle so that the wrench may be operated to manipulate work articles by a simple rotation of the tool handle.

It is a further object of this invention to provide a tool including a combination clamping member and wrench which may be used to initially handle and place a pivoted escutcheon plate about a conduit or pipe at locations remote from the user and thereafter a fixture adjacent the escutcheon plate may be adjusted relative to the plate by the use of the wrench from a remote position.

It is a particular object of this invention to provide a combination wrenching and clamping tool for use in applying pivoted escutcheon plates about adjustable extinguisher drops of overhead sprinkler systems and thereafter utilizing the wrench to rotate the sprinkler head into engagement with the plate so that the plate is substantially abutting the finished ceiling.

BRIEF DESCRIPTION OF THE DRAWINGS

FIG 5 is a top plan view of the combination tool illustrating the placement of a pivoted escutcheon plate with the clamping jaws in a closed position about a sprinkler drop.

FIG. 6 is a section taken through line 6—6 of FIG. 5.

FIG. 7 is a section taken through line 7—7 of FIG. 5.

FIG 8 is an enlarged perspective view of the handle locking pin.

DESCRIPTION OF THE PREFERRED EMBODIMENT

Although the combination tool of this invention may have a plurality of uses in the application of escutcheon or similar type fixtures about a variety of tubular structures, as well as the manipulation of a variety of threaded components, the discussion of the preferred environment of use will be directly associated with the finishing of adjustable sprinkler drops in overhead sprinkling systems.

Figure 1:
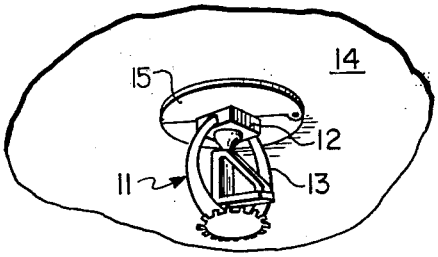
FIG. 1 is a perspective view of a sprinkler head and escutcheon plate after having been mounted and secured adjacent a finished ceiling.

With reference to the drawings, the work objects of the preferred environment are illustrated in FIG. 1 as they would be after final placement utilizing the tool of this invention. Particularly, after the sprinkler drop 10 and sprayer head 11, having a nut portion 12 and outlying members 13, have been installed and the ceiling 14 has been finished, a pivoted escutcheon plate 15 is placed about the sprinkler drop 10 and the sprinkler sprayer head thereafter is rotated by means of the nut portion 12 thereof to adjust the sprinkler drop upwardly so that the sprayer head engages the escutcheon plate 15 and the escutcheon plate abuts the ceiling 14.

In order to apply the escutcheon plate and manipulate the sprayer head from a remote position, a combination clamping and wrenching tool 20 is provided having a tool head 21 and an elongated handle 22. The tool head is connected to the tool handle 22 by means of a generally L-shaped head mounting member 23 having first and second leg portions 24 and 25, respectively, which may be integrally formed or fixedly secured to one another.

The first portion 24 of the L-shaped head mounting member 23 is attached to one end of the tool handle and extends generally perpendicular therefrom so that the second portion 25 of the mounting member 23 is disposed generally parallel to, but in an offset relationship to the axis of the tool handle. The tool head is securely mounted perpendicular to the upper end of the second leg portion 25 of the L-shaped head mounting member 23 so as to be disposed generally perpendicular to the axis of the elongated tool handle 22.

The tool head 21 includes a clamping tool 26 and a wrenching tool 27 which are integrally formed or securely mounted adjacent one another by a throat portion 28 and are shown as being disposed generally outwardly from one another in a substantially common plane.

Figure 3:
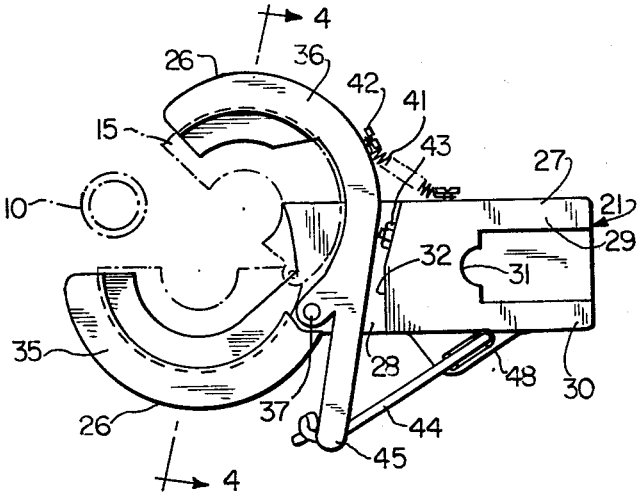
FIG. 3 is a top plan view of the combination tool illustrating the reception of a pivoted escutcheon plate with the clamping jaws in an open position.

With particular reference to FIGS. 3 and 6, the wrenching tool 27 has generally parallel outwardly extending jaw members 29 and 30 which are connected at their base by a contoured U-shaped inner wall member 31. The rearmost portion of the tool 27 defines a wall 32. Further, the inner wall member 31 includes a lower recessed portion 33 to accommodate the outlying sprinkler head member 13 so that the tool 27 engages the nut portion 22 of a sprinkler head 11 without interference. Although the tool 27 is shown as being of the fixed jaw type, it is contemplated that the jaw members 29 and 30 could be made relatively adjustable so that the tool jaws could be opened or closed as desired.

As shown in FIG. 6, the L-shaped mounting portion is of a size of circumvent the sprinkler spray head 11. Further, the wrenching tool 27 extends outwardly so that when the tool is firmly seated against the nut portion 22 of the sprinkler head, the elongated axis of the tool handle is in substantial alignment with the central portion of the opening in the jaws of the tool 27. Thus, the axis of the tool handle will also be aligned with the axis of the sprinkler drop 10. In this manner, any adjustment to the sprinkler drop 10 may be accomplished by a simple rotational or turning movement of the tool handle about its axis. If the axis of the handle and the sprinkler drop were not in alignment, it would be necessary to impart a circular movement to the handle in order to effectuate a rotational movement to the sprinkler drop. The alignment of the tool 27 therefore reduces the effort necessary to rotate the sprinkler members as well as reduces the amount of torque which would otherwise be required if the axis were not aligned.

As previously discussed, a clamping tool 26 is disposed generally outwardly from the opposite side of the tool head 21. The clamping tool 26 is particularly adapted to securely support and subsequently clamp a conventional pivoted escutcheon or similar type plate or fixture about the sprinkler drop 10. In this regard, the clamping tool 26 includes a pair of cooperating arcuately shaped clamping members or tongs 35 and 36 which, when substantially closed against one another, define a generally circular opening.

Figure 4:
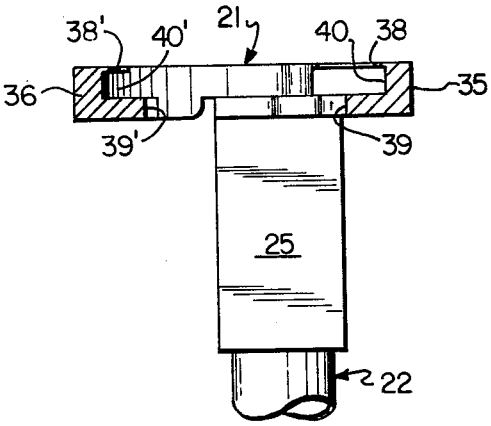
FIG. 4 is a section taken through line 4—4 of FIG. 3.

The clamping member 35 is integrally formed or fixedly attached to the tongue portion 28 of the tool head. However, the clamping member 36 is pivotally attached to the tongue portion 28 by means of a pivot pin 37. With particular reference to FIG. 4, the clamping members 35 and 36 are generally U-shaped in cross-section having upper and lower inwardly extending flanges 38 and 39 and 38' and 39', respectively. The lower flanges 39 and 39' extend inwardly a greater distance than their corresponding upper flanges and thereby serve as seats or supports upon which an escutcheon or similar plate 15 may be placed. Recesses or grooves 40 and 40' are formed between each of the respective flanged portions 38 and 39 and 38' and 39'. The recesses 40 and 40' form a cooperative retention zone in which an escutcheon plate is securely seated during the closure operation of the clamping tool. Also, although the flanges 38 and 39 of clamping member 35 extend substantially the entire length thereof, the flanges 38' and 39' of clamping member 36 may extend only a portion of the length thereof as shown in FIG. 3.

The clamping tool 26 is normally maintained in an open position by a spring 41 or other suitable resilient member. The spring 41 is fixedly secured between the clamping member 36 and the wrenching tool 27 by means of screws or other suitable fastening means 42. In order to conform the clamping tool opening defined between the usually opened clamping members 35 and 36 to the size of an opened pivoted escutcheon plate (as illustrated in FIG. 3), an adjustable positive stop nut 43 is provided adjacent the rear wall 2 of the wrenching tool. As the movable clamping member 36 is urged to its opened position, the stop nut 43 prevents further opening at a preselected point. It is of course envisioned that any other suitable abutting structure or stop means could be used to provide the same restriction to the movement of the clamping member.

Due to the desirability that the clamping tool be capable of being operated when it is extended from a person using the device, an elongated clamping control cord 44 extends from the tool head and downwardly along the tool handle. In order to increase the mechanical advantage in favor of the operator when using the tool, the clamping tong 36 has a lever portion 45 which extends outwardly from the opposite side of the pivot pin from the remaining portion of the tong. An opening 46 is provided through and adjacent the outermost portion of the lever 45 through which the control cord is passed and then secured.

Figure 2:
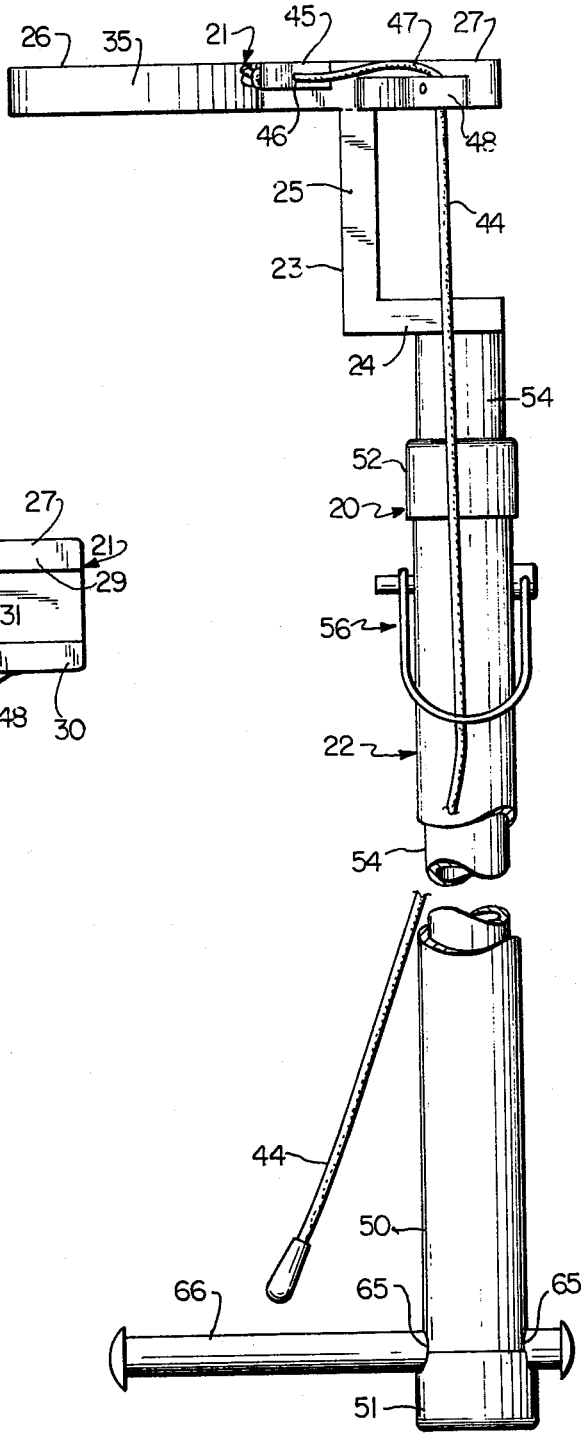
FIG. 2 is a side view of the combination clamping and wrenching tool.

In order that the line of force exerted by the control cord on the lever of the clamping member 36 is directed substantially coplanar therewith, a pulley 47 is rotatably mounted in a recess of a pulley mounting flange 48 which is integrally formed or attached adjacent the side of wrenching tool 27. With reference to FIG. 2, if a downwardly directed force is applied to the control cord 44, the clamping member lever 45 is moved in a generally horizontal direction as the force on the cord is transmitted from a downwardly to a horizontally directed force as the cord passes over the pulley.

Due to the need for a tool which can be utilized at some distance from a person's normal reach, the elongated handle 22 is capable of being telescoped or extended to a variety of lengths. With reference to FIGS. 2 and 6, the elongated handle includes an outer tubular casing 50 having a cap member 51 adjacent the lower end thereof and a sleeve member 52 adjacent the other end thereof. A pair of aligned apertures 53 are provided through the walls of the tubular casing 50 at a point adjacent the sleeve member 52.

Situated interiorly and in sliding engagement with the tubular casing 50 is an extensible inner tubular member 54. A plurality of opposing and aligned apertures 55 are provided through the walls of the inner member 54 and are generally equally spaced along the length thereof.

A locking pin 56 is provided to secure the inner end outer tubular members in a non-adjustable relationship. The locking pin has an elongated shank 57 which is insertable through the apertures 53 of the outer tubular member 50 and selectively insertable through one of the pairs of aligned apertures 55 in the inner tubular member 54. In order to lock the pin within the handle members, a spring retaining clip 58 extends from the enlarged head portion 59 of the pin to a position over and around the tip of the pin remote from the enlarged head portion.

Due to the variety of applications to which the tool could be used, and especially due to the drastic variance in the heights to which the tool may need to be extended, the tool head connector member 23 may be removably attached to the handle 22. As shown in FIG. 6, a retaining lug 60 is integrally formed and extends downwardly from the first leg portion 24 of the L-shaped mounting member. The lug extends therefrom into a sliding engagement with the inner tubular member 54. An opening or bore 61 is formed through the lug 60. When it is desired to secure the tool head to a handle, the lug 60 is inserted into the inner tubular member until the opening 61 is aligned with the uppermost set of spaced apertures 55 in the inner tubular member 54. Thereafter, a roll pin or locking pin 62 is inserted. Of course, any suitable locking means could be used. Also, instead of the lug 60 being formed integrally with the L-shaped mounted member 23, the lug could be a separate member which would be fixedly secured thereto.

In a further effort to assist in the use of the tool, the lower portion of the outer tubular member 50 is provided with a second pair of aligned apertures 65 through which an elongated lever handle 66 is slidably disposed. The handle may be used to gain further mechanical advantage when using the tool to rotate a particular fixture.

In constructing the combined wrenching and clamping tool, it is preferred that the tool head and handle members be constructed of an aluminum based or other lightweight material, however, other more durable metals and metal alloys could be used as well as wood or durable plastic substituted for the handle. The cord is preferably made of a nylon or metallic material. The cap 51 and sleeve 52 may be constructed of rubber or plastic.

Although the combination wrench and clamping tool may be used on a plurality of occasions for placement and/or rotation or manipulation of a variety of fixtures, it is particularly adapted for use in installing ceiling escutcheon plates and adjusting overhead sprinkler drops used in commercial type fire sprinkler sytems. Since the fire extinguishing sprinkler systems are completed except for final adjustment before the ceiling is completed, it is a growing practice to install adjustable drop nipples in the fire extinguishing system, which may be adjusted after the ceiling is finished to cause the sprinkler spray head to be positioned adjacent to the ceiling.

Therefore, in order to allow a degree of adjustability, the sprinkler drops are vertically adjustable relative to the ceiling so that the exact placement of the sprinkler spray heads may be made or altered after the ceiling is installed. With the present tool, after the ceiling is finished, the escutcheon plates for each sprinkler drop may quickly installed and the drop rotated to position the escutcheon plate and the sprayer head in engagement with the ceiling.

When it is desired to use the tool, the handle locking pin 56 is removed and the handle extended to a desired length and the locking pin is reinserted through the apertures 53 and 55 of the outer and inner tubular members 50 and 54, respectively. Thereafter, an opened pivoted type escutcheon plate 15, such as that shown in FIG. 3, is placed on the lower inwardly extruding flanges 39 and 39' of the clamping members 35 and 36 and is thus retained thereon by being situated in the grooves or recesses 40 and 40' formed in the clamping members. The tool is subsequently raised to a working position and the opened escutcheon plate and opened clamping tool positioned around the sprinkler drop 10 at a position adjacent the ceiling and above the sprinkler head 11. When the tool and plate are in position, the user need only apply a downward force on the cord 44 which will cause the movable clamping member 36 to be pivoted about pivot pin 37 and move toward the fixed clamping members 35. As the clamping members are closed, the escutcheon plate, which is prevented from being accidentally misplaced by the upper and lower flange portions of each of the clamping members, is closed about the sprinkler drop 10. The cord 44 is subsequently released the the clamping member 36 is returned to its normally opened position by the action of the spring 41.

With the escutcheon plate in place, the wrenching tool 27 may be used to rotate the adjustable sprinkler drop assembly and cause the sprayer head and escutcheon plate to move upwardly into engagement with the ceiling. Due to the offset configuration of the tool head mounting portion 23 and U-shaped configuration of the forward wall member 31 of the wrenching tool having the underlying recessed portion 33, the jaws 29 and 30 of the tool may be brought into engagement with the nut 12 of the sprinkler head 11 without interference from the outwardly extending members 13. Once the wrenching tool is positioned, the handle is rotated about the axis thereof utilizing the lever handle 66 to gain further mechanical advantage.

We claim:

1. A combination wrench and clamping tool comprising a tool head mounted on one end of an elongated tool handle means, said tool head having a wrench means and a clamping means disposed in a generally opposing relationship, said clamping means having a pair of arcuately shaped tong means, said tong means including means for supporting a pivoted fixture member, at least one of said tong means being movable between an open and closed position relative to the other of said tong means, and remotely controlled operating means for moving said movable tong means into a closing relationship with the other of said tong means, whereby a pivoted fixture member received by said clamping means will be closed as said tongs are moved into said closing relationship.

2. The invention of claim 1 in which said means for supporting a fixture member has upper and lower inwardly extending flanges defining therebetween a recess in which the pivoted fixture member is seated.

3. The invention of claim 1 including resilient means mounted on said tool head to normally urge said movable tong means to said open poition away from said other tong means of said clamping means.

4. The invention of claim 3 including adjustable stop means carried by said tool head means for selectively restricting the opening movement of said movable tong means by selective engagement therewith.

5. The invention of claim 1 in which said movable tong means is pivotally mounted on said head means about a pivot means with lever means extending outwardly from and being securely affixed to said movable tong means so as to be disposed on the opposite side of said pivot means from said movable tong means.

6. The invention of claim 5 in which said remotely controlled operating means includes a pulley means mounted on said tool head means and an elongated cord means, said cord means extending from said lever means along and generally parallel to said tool head means and over said pulley means and along said elongated tool handle means.

7. The invention of claim 1 in which said wrench means includes a pair of spaced jaw means interconnected at their base by a substantially U-shaped well means, the opening defined between said jaw means being in substantial coaxial alignment with the elongated axis of said tool handle means.

8. The invention of claim 7 in which said tool head is connected to said tool handle by a generally L-shaped mounting means having first and second leg portions, said first leg portion extending outwardly generally perpendicularly to said handle means and said second portion extending from adjacent one end thereof so as to be spaced from and generally parallel to the axis of said tool handle means.

9. The invention of claim 7 in which said U-shaped wall means includes an upper and a lower surface, said lower surface being recessed from said upper surface.

10. The invention of claim 1 including an adjustable stop means mounted on said tool head for selectively restricting the opening movement of said movable tong means by engagement therewith.

11. A tool for securing a pivoted ring-like plate around a tubular member comprising a tool head and an elongated handle means, said tool head being mounted adjacent one end of said elongated handle means and including a clamping jaw means, said clamping jaw means having a pair of cooperating tong means, at least one of said tong means being pivotally movable, each of said tong means being generally arcuately shaped and having upper and lower inwardly extending flanged portions defining means for supporting the pivoted ring-like plate, operating means connected to said pivotally movable tong means and extending remotely from said tool head for moving said movable tong means, whereby said clamping means receive an opened pivoted ring-like plate when said clamping means are in an open relationship with one another and the pivoted ring-like plate is maintained within said means for supporting the pivoted ring-like plate of said tong means as said pivotally movable tong means is operated to close said ring-like plate.

12. A combination wrench and clamping tool comprising a tool head means and an elongated handle means, said tool head means being connected to said tool handle means by an offset mounting means so that the connection between said tool head means and said offset mounting means is remote from the line of the elongated axis through said elongated handle means, said tool head means including a clamping tool means and a wrench means disposed in a generally opposing relationship, said wrench means being disposed generally perpendicular to said handle means and having opposing jaw means defining an opening therebetween, the axis of the jaw opening of said wrench means being in substantial alignment with the elongated axis of said elongated handle means, whereby the operative movement of said wrench means is made in response to the rotation of said elongated handle about its axis.

13. The structure of claim 12 in which said wrench means includes a substantially U-shaped wall means connecting said opposing jaw means, said wall means having upper and lower surfaces, said lower surface being recessed relative to said upper surface, whereby said U-shaped wall and said recessed lower surface accommodate outlying components of a work article being acted upon by said wrench means.

* * * * *